US005987655A

United States Patent [19]

Smet

[11] Patent Number: 5,987,655

[45] Date of Patent: Nov. 23, 1999

[54] FLUSH TANK WATER CONDITIONER

[76] Inventor: Stephen J. Smet, 16610 Cashell Rd., Rockville, Md. 20853

[21] Appl. No.: 09/133,598

[22] Filed: Aug. 13, 1998

Related U.S. Application Data

[63] Continuation of application No. 08/834,855, Apr. 10, 1997, abandoned.

[51] Int. Cl.[6] ..... E03D 9/02

[52] U.S. Cl. ..... 4/225.1; 4/227.1; 4/223

[58] Field of Search ..... 4/225.1, 223, 227.1

[56] References Cited

U.S. PATENT DOCUMENTS

| | | | |
|---|---|---|---|
| 2,570,934 | 10/1951 | Foster | 4/225.1 |
| 2,697,841 | 12/1954 | Collins | 4/225.1 |
| 2,761,151 | 9/1956 | Ferrando | 4/225.1 |
| 3,112,499 | 12/1963 | Thornton | 4/222 |
| 3,504,384 | 4/1970 | Radley et al. | 4/227.6 |
| 3,597,772 | 8/1971 | Leavitt et al. | 4/222 |
| 3,867,101 | 2/1975 | Herring | 4/227.1 X |
| 3,911,507 | 10/1975 | Johnson | 4/224 |
| 4,142,260 | 3/1979 | Snyder | 4/223 |
| 4,229,410 | 10/1980 | Kosti | 4/226.1 |
| 4,281,421 | 8/1981 | Nyquist et al. | 4/227.6 |
| 4,312,082 | 1/1982 | Murphy et al. | 4/225.1 |
| 4,416,854 | 11/1983 | Nielsen | 4/227.1 X |
| 4,435,857 | 3/1984 | Meloy | 4/227.6 |
| 4,450,594 | 5/1984 | Hotchkin | 4/227.6 |
| 4,453,278 | 6/1984 | Doggett et al. | 4/227.7 |
| 4,460,490 | 7/1984 | Barford et al. | 252/92 |
| 4,467,480 | 8/1984 | Keller | 4/225.1 |
| 4,480,341 | 11/1984 | Richards | 4/227.7 |
| 4,485,500 | 12/1984 | Melville, Jr. | 4/227.7 |
| 4,530,118 | 7/1985 | Richards | 4/227.6 |
| 4,539,179 | 9/1985 | Meloy | 422/28 |
| 4,587,069 | 5/1986 | Meloy | 264/102 |
| 4,597,941 | 7/1986 | Bottom et al. | 422/37 |
| 4,605,534 | 8/1986 | Meloy | 422/37 |
| 4,668,475 | 5/1987 | Meloy | 422/37 |
| 4,738,833 | 4/1988 | Gray | 422/266 |
| 4,755,354 | 7/1988 | Trinh et al. | 422/37 |
| 4,800,066 | 1/1989 | Sinclair et al. | 422/55 |
| 4,821,346 | 4/1989 | Jones | 4/225.1 |

OTHER PUBLICATIONS

Rod Chamberlin, "FAX About Chemistry for Pools Spas and Hot Tubs", Absolute Spa Services Web Site. [http://infomatch.com/~spaguy/faqchem.htm], ©1995, 12 pgs.

Rod Chamberlin, "Alternative Sanitizers", Absolute Spa Services Web Site. [http://infomatch.com/~spaguy/altrsant.htm], ©1995, 12 pgs.

Rod Chamberlin, "Handling and Storage of Chemicals", Absolute Spa Services Web Site. [http://infomatch.com/~spaguy/chemical.htm#temperature], ©1995, 2 pgs.

Rod Chamberlin, "Water Balance/Water Conditioning", Absolute Spa Services Web Site. [http://infomatch.com/~spaguy/hndlstrg.htm], ©1995, 9 pgs.

Rod Chamberlin, "Oxidizers", Absolute Spa Services Web Site. [http://infomatch.com/~spaguy/wtrbal.htm#oxidizer], ©1995, 16 pgs.

Rod Chamberlin, "Algae and Algaecides", Absoute Spa Services Web Site. [http://infomatch.com/~spaguy/algae.htm], ©1995, 3 pgs.

*Primary Examiner*—Robert M. Fetsuga

[57] ABSTRACT

A flush tank water conditioner includes an elongate water-soluble solid chemical compound column adapted to be suspended in the overflow tube of a conventional toilet reservoir tank. The overflow tube located column dries between toilet operations to conserve conditioning chemicals and to prevent over concentration. A dye material embedded at the center of the disinfectant column is released as an end-of-useful-life indicator.

21 Claims, 2 Drawing Sheets

FLUSH TANK WATER CONDITIONER

This application is a continuation application of pending application Ser. No. 08/834,855, entitled "Flush Tank Water Conditions" filed Apr. 10, 1997, abandoned. The disclosure in that co-pending application is incorporated herein by reference in its entirety.

BACKGROUND OF THE INVENTION

1. Field of the Invention

The present invention pertains to a flush tank water conditioner of the type consisting of compressed water soluble disinfecting chemicals adapted for placement in the reservoir tank of conventional flush toilets and, more particularly, to a block of disinfectant composition placed in the refill tube of the reservoir tank to dissolve only during the flushing and refilling phase of the toilet operation and to signal impending depletion by the release of a dye material.

2. Discussion of the Prior Art

Stains and rings formed in porcelain toilet bowls as a result of water, frequently mineral rich, standing at a fixed level and disturbed only by irregular flushings creates a sanitary and aesthetic problem. A number of alternative approaches have been developed in the prior art to introduce disinfectant detergent agents into the elevated reservoir tanks of typical flush toilets to subsequently wash through the bowl to neutralize, condition and/or disinfect the toilet bowl water and thus to overcome this difficulty. Typically, ported dispensers containing water soluble treatment compounds are suspended within the toilet reservoir tank to automatically release a metered quantity of concentrated solution into the tank and/or bowl each time the water level within the tank is lowered and raised by the flushing sequence.

In U.S. Pat. No. 4,416,854 (Nielsen), a pair of electrolytically-reactive elemental metals, such as zinc and copper, are formed into chips and placed in a perforated container that hangs on the side of the toilet reservoir tank to submerge and activate the metals in the reservoir water producing a biocidal solution fatal to bacteria and algae yet not unsafe for human beings.

An analogous method of disinfecting toilet flushing water is taught in U.S. Pat. No. 4,229,410 (Kosti) wherein water soluble chemical agents are suspended in a mesh basket in the main drain tube below the drain closure valve between the toilet reservoir tank and the bowl rather than in the tank itself. Access for replacement is impractically difficult in this arrangement.

A closed container or tank that is inserted into the flow line between the float valve and overflow pipe houses a disinfectant disc or tablet and directs the flow of afterfill inlet water over and around the tablet after the toilet flushing operation is shown in U.S. Pat. No. 2,570,934 (Foster). The tablet container is clamped into position between the toilet tank top and the upper portion of the overflow pipe and access for tablet replacement is provided by a removable cover plate.

Passive dosing dispensers rely on the alternating cycles of flooding and syphoning of tank water through a chamber containing soluble disinfecting chemicals. These devices are dependent on the intervals between flushes to control concentrations. U.S. Pat. No. 4,281,421 (Nyquist et al) among others describes such a passive toilet tank dispenser that is immersed in the tank reservoir and receives water into an internal receptacle as the reservoir water level rises after a flush sequence. The internal receptacle is isolated from the tank by an air lock when the tank is full, and the entrapped water contacts a water soluble disinfectant cake to create a concentrated solution within the receptacle that is released to the toilet tank when a subsequent flush sequence lowers the tank level and breaks the air lock.

Dyes have been used to indicate the presence of disinfectant, as exemplified by the deep blue hue that accompanies water treated by a popular reservoir cleaning tablet, or to indicate the impending depletion of the disinfecting agent, as exemplified by U.S. Pat. No. 3,867,101 (Herring) wherein an indicator dye is enclosed in soluble disinfectant and released when the disinfectant dissolves to a predetermined level.

The prior art toilet tank water conditioner dispensers have generally suffered from one or more common disadvantages, namely a propensity to continuously dissolve between flushings causing wasteful over-concentration of treatment chemicals, unsightly support mechanisms visible outside the tank, awkward and inconvenient refill and replacement requirements, reliance on somewhat exact placement with respect to tank water levels and/or persistent discoloration of bowl water to indicate continuing disinfection.

SUMMARY OF THE INVENTION

Accordingly, it is a primary object of the present invention to overcome the shortcomings of the prior art by providing an economical passive water treatment apparatus independent of time interval between flush cycles for installation within the reservoir tank of a flush toilet.

Another object of the present invention is to provide an economical toilet cleaning and disinfecting device that treats the volume of water passing through the overflow tube.

A further object of the present invention is to provide a water soluble treatment system for flush toilets that does not necessarily dissolve between flush cycles.

Yet another object of the present invention is to provide a toilet bowl cleaner and disinfectant that is simply installed in the toilet tank without the need for tools, tank rim support holders or water level sensitive vertical positioning.

A still further object is to provide a treatment device easily adapted to selectively treat bowl water only, tank water, or both.

An additional object is to provide a toilet water treatment device that signals the need for replenishment or replacement by tinting the color of the basin water.

The aforesaid objects can be achieved individually and in combination and it is not intended that the invention be construed as requiring that two or more objects be combined.

The present invention is generally characterized as an oblong generally column-shaped bar of water soluble water conditioning chemical compound formulated to provide toilet bowl sanitization, cleansing, demineralizing and deodorization compressed onto a support structure configured to suspend the chemical bar in the inlet flow path of the toilet overflow tube. A second compressed composition bar can be attached to the support and suspended in the tank outside the overflow tube to simultaneously provide treatment to the reservoir or tank water. An inert chemical dye can be homogeneously mixed in the compressed bar to indicate the presence of the conditioner or alternatively, can be used to form the innermost portion of the compressed bar, nearest to the support, to be released into the water as the bar depletes indicating the need for replacement. During the flush cycle water discharged directly from the inlet valve into the overflow tube flows over the surfaces of the compressed bar absorbing treatment chemicals as it passes through the tube, past the toilet tank drain and into the bowl. At the end of the flush cycle the overflow tube, in direct communication with the bowl below, drains and the compressed bar of soluble disinfectant suspended therein air dries.

The foregoing and other objects, features and advantages of the present invention will be more fully apparent upon considering the following detailed description of preferred embodiments thereof, particularly when viewed in connection with the accompanying drawings wherein like reference numerals in various figures are used to designate like components.

DESCRIPTION OF THE PREFERRED EMBODIMENT

Figure 1:
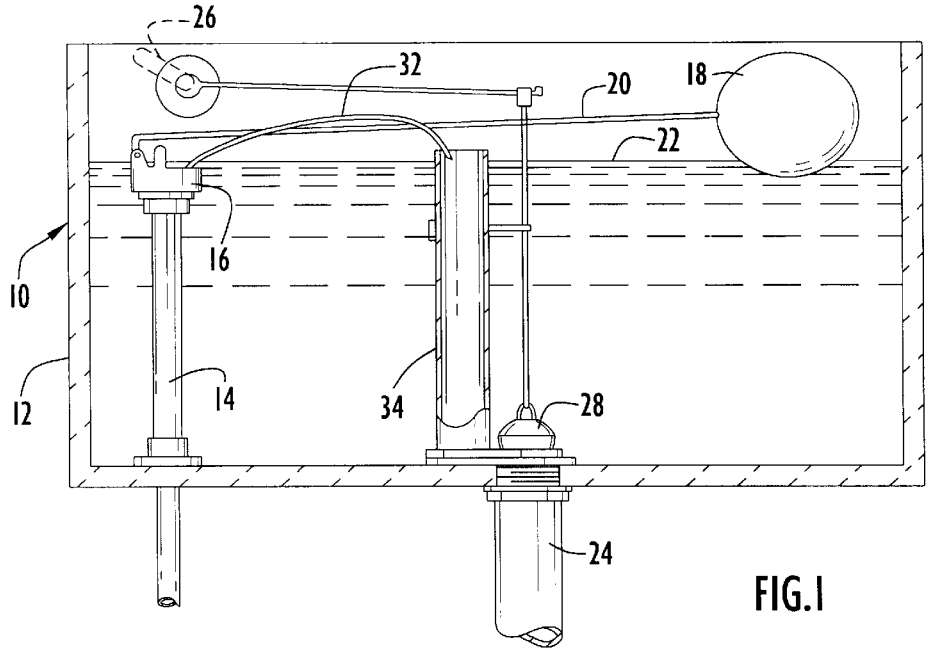
FIG. 1 is a fragmentary sectional view of a conventional prior art toilet tank.

A typical conventional toilet tank assembly 10, shown in FIG. 1, includes a tank 12 filled by water entering through an inlet pipe 14 and a valve 16 activated by a float 18 cantilevered on an arm 20. Inlet valve 16 is opened when the water level 22 within the tank drops below a preselected upper height during toilet flushing thereby allowing the float 18 to drop and the attached arm 20 to rotate downward. Tank water is released into the toilet bowl through drain 24 when handle 26 is depressed and unseats an outlet valve 28. The outward flow lowers the tank water level and float valve 16 opens to permit an inward flow somewhat less in flow rate than the outflow through the drain. A portion of the inflow water is directed through a water line 32 into an overflow tube 34 in direct communication with toilet drain 24 to refill the bowl (not shown) after outlet valve 28 has reseated in response to a predetermined lower level, generally near empty.

Figure 2:
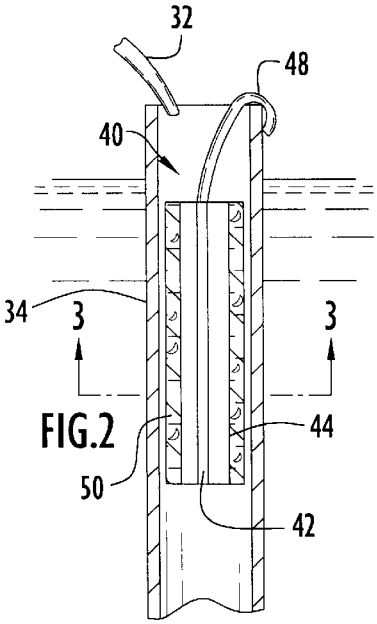
FIG. 2 is a cross-sectional view of the present invention.

The flush tank water conditioning device 40 according to the present invention, shown in FIG. 2, comprises an insoluble support frame 42 having a downwardly extending elongate support leg 44, a mounting hanger member or hook 48, and a mixture or compound of one or more water soluble water conditioning agents 50 compressed onto leg 44 to form a downwardly extending soluble column insertable within the flow of water from line 32 into overflow tube 34, and sized to be dissolvably washed by this flow without materially interfering with the flow rate through the tube.

Figure 3:
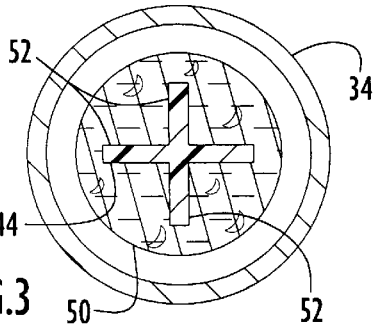
FIG. 3 a plan view of the present invention taken along line 3—3 in FIG. 2.
Figure 4:
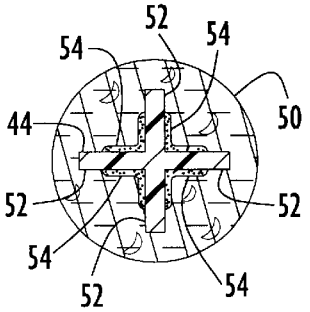
FIG. 4 is a plan view of the present invention with dye material embedded between the support leg and the water treatment compound.

As shown in FIGS. 3 and 4, one embodiment of the support frame leg comprises orthogonal fins 52 extending along the elongate length of leg 44 to provide ample surface area for the compressed compound to adhere. Further, the leg or fin surfaces can be dimpled or perforated to enhance adhesion. A layer of water soluble dye 54 may be embedded along and between the support leg and the compressed water treatment compound as shown in FIG. 4 to be released to tint the toilet bowl water as an indicator that the water conditioning device is near depletion and to signal the need for replacement. Alternatively, a dye mixture may be intermixed with the water treatment compound to provide an ongoing indication of the presence of the disinfectant.

Figure 5:
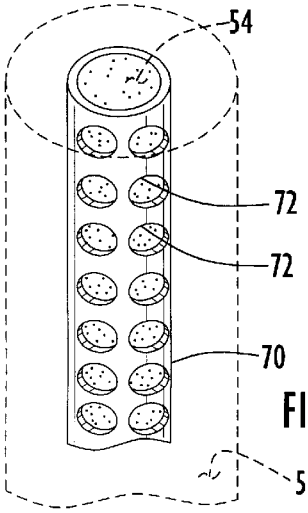
FIG. 5 is a cutaway partial perspective view of a perforated tube embodiment of the support leg of the water conditioner of the present invention.
Figure 6:
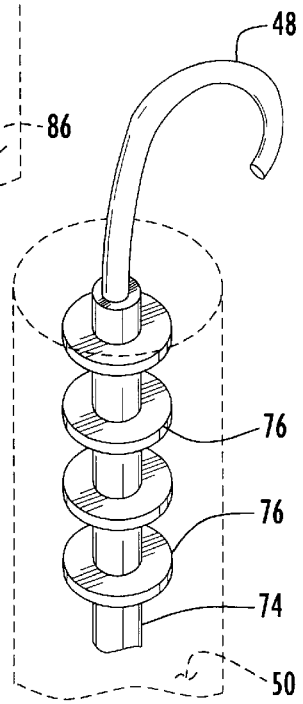
FIG. 6 is a cutaway partial perspective view of a ringed rod embodiment of the support leg of the water conditioner of the present invention.

The geometry of the support leg, shown in FIGS. 2, 3, and 4 as orthogonal fins, is controlled only by the need to provide adherable support for the compressed chemicals and dyes and to encourage uniform dissolution of the treatment compound. An open cylinder 70 having spaced perforations 72, shown in FIG. 5, with the dye material 54 contained within and the water treatment material 50 compressed onto the exterior is contemplated as an alternative embodiment, as is a rod 74 with spaced exterior rings 76 providing adhering surfaces for the compressed material as shown in FIG. 6. Any number of other shapes suitable to the requirements will suggest themselves to those knowledgeable in the field and all such are considered to be encompassed by the disclosures herein contained. Similarly the inventive concept of the present invention is not limited to columnar bodies of compressed chemical compounds but contemplates any alternative configuration or geometry capable of insertion into the intake flow through the overflow tube without significantly interfering or reducing the water flow.

Figure 7:
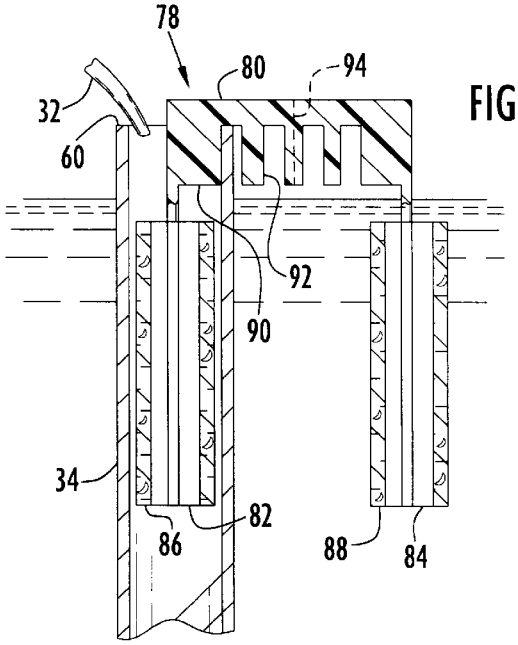
FIG. 7 is cross-sectional view of an alternative embodiment of the present invention.

In an alternative embodiment 78, shown in FIG. 7, an insoluble cross member support frame 80 extends between first and second downwardly extending elongate support legs, 82 and 84, respectively. Water soluble water treatment agents 86 and 88 are formed along the first and second support legs, 82 and 84, respectively, with dye materials optionally embedded in the treatment compounds or layered adjacent to the support legs to provide visual indication of the presence or absence of active water treatment.

The lower portion 90 of cross-member 80 has one or more notches or slots 92 formed therein for supporting device 78 on the top edge 60 of overflow tube 34 with first support leg 82 extending downward into the overflow tube and second leg 84 extending downward into the toilet tank reservoir exterior to the overflow tube. The number and spacing of support notches 92 allows first support leg 82 to be adjustably positioned within overflow tube 34 to align fully or partially with the downward flow of water from valve 16 through waterline 32. In embodiments comprising cross-members 80 having two or more support notches 92, a line of perforations or indentations 94 is preformed vertically along the cross-member centerline to facilitate division of device 78 into two separate columns of compressed water treatment compound each separately supportable by the attached portion of notched cross-member. On the other hand, where simultaneous use within the overflow tube to treat bowl water and outside the overflow tube to treat reservoir tank water is contemplated, different mixtures, formulations or concentrations of the water treatment chemicals may be compressed onto the two legs.

The water soluble conditioning material of the present invention may effectively comprise any of a wide range of disinfectants, sanitizors or cleansing and/or oxidizing agents, however, chlorine compositions, forming hypochlorous acid when dissolved in water, have been found to perform all of the functions as well as acting as an algicide, algostat and bacteriostat. Calcium hypochlorinate is one such composition amenable to formation in a cake-like form compactable or compressible onto support legs of the sort shown as components 44, 70, 74 in FIGS. 3, 5 and 6, respectively, however the selection of a particular disinfectant, dye or other material is not critical for the purposes of the present invention. One need only combine the chemical properties and dissolution rate appropriately with the flow characteristics through the overflow tube to produce the desired characteristics in the treated bowl and tank mixture.

Each time the toilet is flushed, a portion of the water flowing through the overflow tube 34 contacts the water soluble water treatment compound 50 dissolving a portion thereof to produce a disinfectant surface rinse of the toilet bowl until the outlet valve 28 reseats, and to provide a treated solution in the bowl thereafter until the next flush. Between flushes no flow occurs in the overflow tube and the column of water soluble disinfectant compound dries to prevent continuing dissolution, over-concentration and waste.

Figure 8:
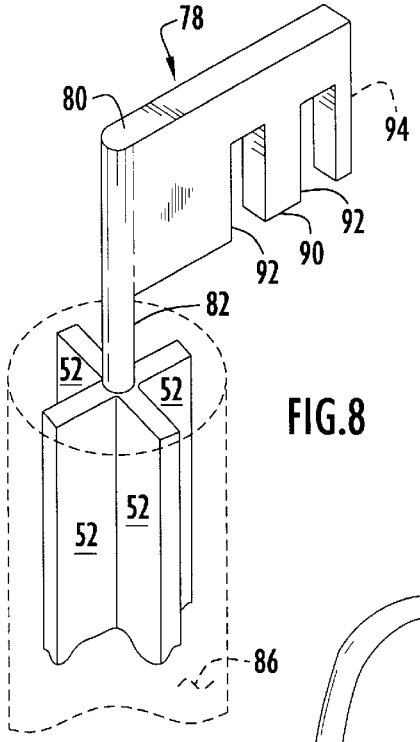
FIG. 8 is a cutaway partial perspective view of a water conditioner according to the alternative embodiment of the present invention divided along a perforated centerline to be supported only within the overflow tube.

In a second mode of use, the water treatment device of present invention shown as 78 in FIG. 7 is separated along perforation line 94 to form two separate columns of disinfecting compound, each usable separately as shown in FIG. 8. One column is supported, extending downward within the overflow tube, by affixing one of the notches formed in the cross-member over the upper edge of the over flow tube. The second column can be used in a separate toilet or saved for later.

In a third mode of use, no division of the two legs is made and the device is supported on the overflow tube upper edge by one of the connecting cross-member notches with one column extending downward into the overflow tube to perform as described above and the other extending into the toilet tank reservoir for continuous contact with the water therein contained.

Water soluble dye can be mixed with the water treatment compound to provide a visible signal that active disinfectant is ongoing or, alternatively, released only after substantially all of the disinfectant has dissolved to signal the need for replacement.

In view of the foregoing, it is apparent that the present invention presents a unique and efficient procedure for economically providing a passive water treatment device producing predetermined levels of cleaning and/or disinfecting concentrations independently of the time interval between flushes, and which can be easily and inconspicuously mounted in the toilet reservoir tank. The invention having now been fully described, it should be understood that it may be embodied in other forms and variations without departing from its spirit or essential characteristics. Accordingly, the embodiments herein described are to be considered illustrative rather than restrictive and the scope of the invention is indicated by the appended claims rather than the foregoing description. All changes which come within the meaning and range of equivalency of the claims are intended to be embraced therein.

What is claimed is:

1. An apparatus for cleaning and disinfecting inflow water flowing through the overflow tube of a toilet into the toilet bowl, the apparatus comprising:

a first elongate support leg configured to extend longitudinally within the overflow tube;

first water-soluble water treatment chemicals compressed onto a surface of said support leg;

a second elongate support leg extending parallel to said first elongate support leg;

second water-soluble water treatment chemicals compressed onto a surface of said second elongate support leg; and a cross-member extending between said elongate support leg and said second elongate support leg, said cross-member being configured to suspend said first elongate support leg within the inflow water directed through the overflow tube.

2. The apparatus according to claim 1, wherein:

said first elongate support leg comprises first projecting members extending radially outward from a center of said first elongate support leg; and said second elongate support leg comprises second projecting members extending radially outward from a center of said second elongate support leg.

3. The apparatus according to claim 2, wherein:

a surface of each of said first projecting members extends longitudinally along said first elongate support leg; and a surface of each of said second projecting members extends longitudinally along said second elongate support leg.

4. The apparatus according to claim 2, wherein:

said first projecting members comprise radially extending rings attached along said first elongate support leg; and said second projecting members comprise radially extending rings attached along said second elongate support leg.

5. The apparatus according to claim 1, wherein said cross-member includes notches that are engageable with an upper edge of the overflow tube for suspending said first elongate support leg from the upper edge of the overflow tube.

6. The apparatus according to claim 1, wherein said cross-member includes perforations for facilitating separation of said cross-member into two portions.

7. The apparatus according to claim 1, further comprising water-soluble dye intermixed with said first and second water-soluble water treatment chemicals to indicate presence of dissolved chemicals in the toilet bowl water.

8. The apparatus according to claim 1, further comprising:

a first layer of water-soluble dye compressed adjacent said first elongate support leg to indicate depletion of said first water-soluble water treatment chemicals.

9. A method of treating water in the bowl of a toilet, the toilet having a reservoir tank, and a water inlet pipe operated by an inlet valve to pass the majority of inflow water into the toilet tank and a small quantity of inflow water through a water line discharging into an overflow tube in communication with the toilet bowl during toilet flushing and having an upper edge, said method comprising the steps of:

(a) suspending within the toilet overflow tube a first elongate body comprising a first longitudinally-extending support leg with first water-soluble water treatment chemicals compressed onto a surface of said first support leg;

(b) positioning said first elongate body in the overflow tube inflow water for dissolving a portion of said first water-soluble water treatment chemicals into said overflow tube inflow water during toilet flushing;

(c) connecting one end of said first elongate body to a first end of a cross-member;

(d) connecting a second elongate body to a second end of said cross-member, said second elongate body comprising a second longitudinally-extending support leg with second water-soluble water treatment chemicals compressed onto a surface of said second support leg;

(e) engaging the cross-member with a top edge of the overflow tube such that said first elongate body extends into the overflow tube and said second elongate body extends into the toilet tank;

(f) introducing said overflow tube inflow water and said dissolved said water-soluble water treatment chemicals into the toilet bowl during each toilet flushing; and (g) allowing said first elongate body to air-dry between toilet flushings to prevent continuing dissolution of said first water-soluble water treatment chemicals.

10. The method according to claim 9, further comprising the steps of:

(h) forming said first support leg with first projecting members which extend radially outward from a center of said first support leg; and (i) forming said second support leg with second projecting members which extend radially outward from a center of said second support leg.

11. The method according to claim 10, wherein:

step (h) includes extending a surface of each of said first projecting members longitudinally along said first support leg; and step (i) includes extending a surface of each of said second projecting members longitudinally along said second support leg.

12. The method according to claim 10, wherein:

step (h) includes forming said first projecting members as radially extending rings attached along said first support leg; and step (i) includes forming said second projecting members as radially extending rings attached along said second support leg.

13. The method according to claim 9, wherein step (e) includes forming notches in said cross-member that are engageable with an upper edge of the overflow tube for suspending said first elongate body from the upper edge of the overflow tube.

14. The method according to claim 9, further comprising the step of:

h) forming perforations in said cross-member for facilitating separation of said cross-member into two portions.

15. The method according to claim 9, further comprising the step of:

h) intermixing a dye material intermixed with said first and second water-soluble water treatment chemicals to tint the water in the toilet bowl, thereby indicating presence of said first and second water-soluble water treatment chemicals.

16. The method according to claim 9, further comprising the step of:

h) compressing dye material between said first support leg and said first water-soluble water treatment chemicals to tint the water in the toilet bowl, thereby indicating depletion of said first water-soluble water treatment chemicals.

17. In a toilet having a bowl, a tank, and a water inlet pipe operated by an inlet valve supplying inflow water into the reservoir tank and into an overflow tube in communication with the toilet bowl, an apparatus for cleaning and disinfecting toilet tanks and bowls, said apparatus comprising an insoluble support structure having a first and second elongate support legs and a cross-member extending therebetween, a first elongate body of water-soluble water treatment chemicals compressed onto said first leg and configured to extend downwardly within the toilet tank overflow tube, a second elongate body of water-soluble water treatment chemicals compressed onto said second leg and configured to extend downward within the toilet tank, and means for supporting said cross-member to suspend said first elongate body within the inflow water directed into the overflow tube and said second elongate body into the water in the toilet tank.

18. The apparatus of claim 17 further comprising water-soluble dye intermixed with said water-soluble treatment chemicals compressed onto at least one of said support legs to indicate presence of dissolved chemicals in the toilet bowl.

19. The apparatus of claim 17 further comprising a layer of water-soluble dye compressed adjacent at least one of said support legs to indicate depletion of said water treatment chemicals.

20. The apparatus of claim 17 wherein said support means comprises at least one notch formed in said cross-member to supportingly engage the upper edge of the toilet tank overflow tube.

21. The apparatus of claim 17, wherein said support means comprises at least two spaced notches formed in said cross-member each configured to supportingly engage the upper edge of the toilet tank overflow tube, and further comprising a line of perforations formed along the cross-member centerline to facilitate division of said apparatus into two separately supportable downwardly extending elongate bodies of water treatment chemicals.

* * * * *